United States Patent [19]

Riha et al.

[11] 3,982,568

[45] Sept. 28, 1976

[54] DEVICE FOR GRIPPING AND FORMING A SUPPLY OF WEFT THREAD BEFORE WEFT INSERTION

[75] Inventors: Miloslav Riha; Josef Martinec; Jiri Cernocky, all of Vsetin, Czechoslovakia

[73] Assignee: Zbrojovka Vsetin, narodni podnik, Vsetin, Czechoslovakia

[22] Filed: Apr. 9, 1975

[21] Appl. No.: 566,412

[30] Foreign Application Priority Data

Apr. 12, 1974 Czechoslovakia ..... 2638-74

[52] U.S. Cl. ..... 139/452

[51] Int. Cl.[2] ..... D03D 47/36

[58] Field of Search ..... 139/122 H, 122 R, 127 P, 139/450–453; 66/132 R, 132 T; 242/47.01, 47.12

[56] References Cited

UNITED STATES PATENTS

| | | | |
|---|---|---|---|
| 2,519,786 | 8/1950 | Paabo | 139/127 P |
| 2,668,560 | 2/1954 | Svaty | 139/127 P |
| 3,229,725 | 1/1966 | Saito | 139/122 H |
| 3,370,618 | 2/1968 | Svaty et al. | 139/122 H |
| 3,411,547 | 11/1968 | Bucher | 139/122 H |
| 3,776,282 | 12/1973 | Sevcik | 139/122 H |

FOREIGN PATENTS OR APPLICATIONS

| | | | |
|---|---|---|---|
| 123,403 | 6/1967 | Czechoslovakia | 139/122 H |
| 2,031,995 | 11/1970 | France | 139/122 H |
| 1,925,602 | 12/1969 | Germany | 139/122 H |

*Primary Examiner*—James Kee Chi

[57] ABSTRACT

Device for gripping and forming a supply of measured weft thread before weft insertion in a shuttleless loom. The weft measuring means includes a rotary measuring drum with a nip disc. The inner space of the measuring drum is mounted on a driving shaft on which there is also mounted an axially displaceable gripping disc which is provided with an axially projecting toothed rim at its outer circumference. The device is provided with an annular housing coaxial of the measuring drum in the opposite inner wall of which there is provided an annular frontal groove, the position and size of which correspond to the axially projecting toothing on the gripping disc. The measured weft is delivered to the weft inserter from the measuring drum through the annular frontal groove to a central apex guide in advance of a weft inserting means.

4 Claims, 3 Drawing Figures

DEVICE FOR GRIPPING AND FORMING A SUPPLY OF WEFT THREAD BEFORE WEFT INSERTION

The present invention relates to a device for gripping and forming a supply of measured weft thread before weft insertion in a loom. The device is particularly suitable for high-speed shuttleless looms in which the necessary length of weft thread has to be measured in advance.

A known requirement for high-speed shuttleless looms with various principles of weft insertion is to withdraw the weft thread from the supply bobbin continuously at a constant speed in such manner as constantly to form a balloon upon withdrawal, said balloon reducing the friction of weft thread about the body of the supply bobbin.

This requirement was successfully met by the construction of a measuring device with constant and continuous weft thread withdrawal from the supply bobbin. However, this causes other problems: How and where a part of the measured weft thread length is to be stored must be considered since, in relation to the operating cycle of the weaving machine, said length cannot be inserted into the shed immediately and thus should be stored in such manner as to be capable of being withdrawn with a minimum resistance at the moment of initiating the weft insertion, and to prevent the weft from being damaged or broken due to the change of speed of its withdrawal.

This problem has been solved, e.g. by a known device in which the weft thread is sucked into a special tube which is situated behind a nip roller and inside which there is underpressure. The weft thread supply is deposited inside said tube in the form of a loop until the moment at which it is inserted into the shed by the action of the weft inserting device. Thereupon it is necessary to overcome the force retaining the weft thread by underpressure, the consequence of which is a deformation or displacement of separate fibers or filaments of the weft thread to be inserted, and thus also a reduced quality of the resulting fabric.

In another known device, the weft thread is gripped by means of a retaining detent, or at a given moment is sucked onto the circumference of a measuring drum through an opening which connects the inner space to an underpressure pipeline. After being gripped, the weft thread is wound onto the measuring drum.

Before withdrawing the weft thread, when a detent is employed, the retaining detent is tilted and the thread released, while in the second case, the gripping of the weft thread by sucking, the action of underpressure is interrupted. The disadvantage of such devices consists in that the weft thread is gripped only at one point on the circumference of the measuring drum, and therefore the length of weft thread cannot be easily changed. This can be achieved either by changing the diameter of the measuring drum or by completing the measuring device by a means for depositing the formed loop, during measurement of the weft thread by the measuring device, before its being gripped and deposited onto the measuring drum.

In another known device, the weft thread is gripped immediately after insertion between a rotating measuring drum and a nip disc which is pressed at the proper time in the operation cycle of the machine, axially against the measuring drum and alternatingly withdrawn therefrom. In this case the weft thread is gripped at an arbitrary point between the contact surfaces on the circumference of the measuring drum and the nip disc. When using this device, wastage of the weft thread is reduced up to 50 percent. However, a disadvantage of such device is that the weft thread is firmly gripped relatively soon after insertion. At that time, the weft thread has not yet fully come to rest. Furthermore, the nip disc causes an increased noise level during the operation of the machine because of rhythmical pressing of the disc against the measuring drum.

The above-mentioned disadvantages of known devices of the type described are mitigated by the device according to the present invention. In the device of the invention, an axially displaceable gripping disc is used for gripping the weft thread before its being deposited, said disc being mounted in the hollow of the measuring drum, rotating at the same speed, and being provided on its outer circumference with an axially projecting toothed rim. In the opposite wall of the stationary housing there is a front groove, the position and size of which correspond to the axially projecting toothing on the gripping disc.

The advantage of this device is that the weft thread is retained without being firmly gripped, and that the operation of said device is noiseless. Moreover, the whole device is much simpler in its design and occupies less space than any of the known devices for gripping weft thread and forming a supply thereof.

The device for gripping the weft thread according to the present invention is shown in the accompanying drawing, in which.

Figure 1:
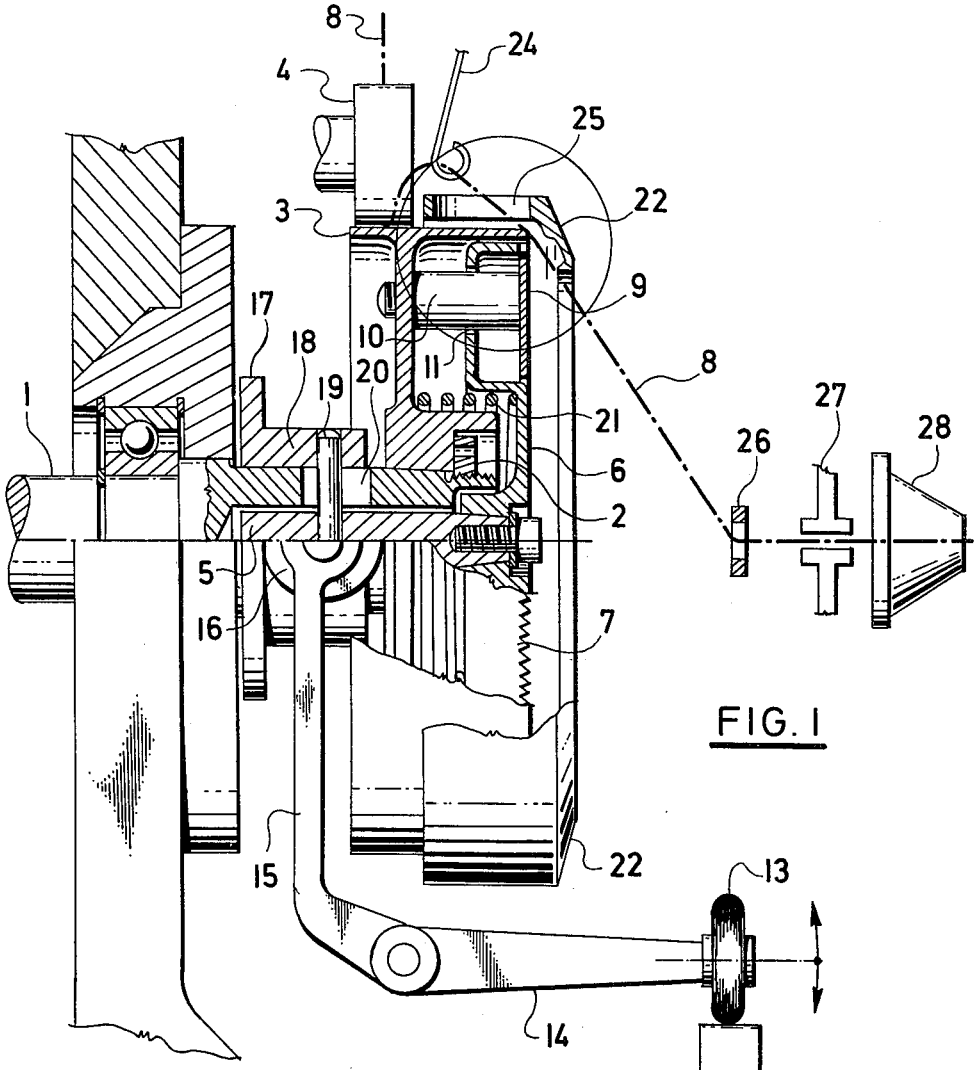
FIG. 1 is a view partially in vertical axial section and partially in side elevation of the device.
Figure 2:
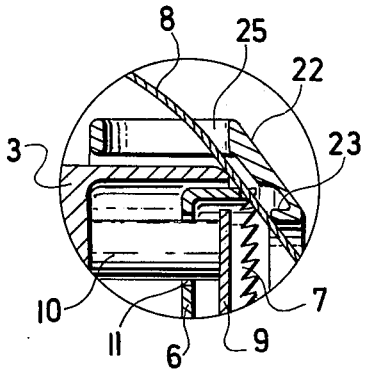
FIG. 2 is a detailed view of the portion of the device in the circle in FIG. 1 at the moment of gripping the weft thread.
Figure 3:
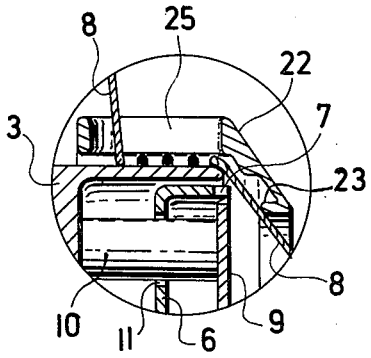
FIG. 3 is a detailed view of the portion of the device shown in FIG. 2 at the moment of releasing the weft thread by a retaining disc before its being withdrawn and inserted into the shed.

On the end of a driving shaft 1 there is fastened a measuring drum 3 by means of a nut 2, there being a nip roller 4 bearing against said drum 3. In a bore at the end of driving shaft 1 there is displaceably mounted a pivot shaft 5 which is firmly connected to a gripping disc 6; disc 6 is provided at its outer circumference with an axially projecting rim with saw-like toothing 7. The device is provided with an annular member 9 for the more reliable withdrawal of weft thread 8 from the tooth of the gripping disc 6 upon withdrawal. Member 9 is firmly connected to measuring drum 3 by means of spacer studs 10 passing freely through openings 11 in the gripping disc 6.

The axial motion of gripping disc 6 is initiated, upon withdrawing weft thread 8, by means of a cam 12 which is driven in synchronism with the other parts of the loom, the cam 12 acting upon a two-arm lever 14 via cam follower roller 13. Said lever presses with its other end 15, via a roller 16, against a flange 17 on a sleeve 18, the sleeve being firmly connected by means of a pivot stud 19 passing freely through a groove 20 in the driving shaft 1 to pivot shaft 5 and thus also to gripping disc 6. The reverse motion of pivot shaft 5 with gripping disc 6 is initiated upon the gripping of weft thread 8, by a compression spring 21 mounted on the hub of the measuring drum 3 and having its other end bearing against the gripping disc 6. The device is covered by a housing 22 which is mounted on the frame of the loom. In the inner wall of housing 22, a frontal groove 23 is provided, of which the position and size corresponds to the axially projecting toothing 7 on the gripping disc 6.

The weft thread 8 if fed from a supply bobbin (not shown) below the nip wheel 4 and passes via guide 24 into an opening 25 in housing 22 via circumferential edge of measuring drum 3 as far as a central eyelet 26 and passes between the jaws of pliers 27 to a weft inserting means 28.

The device of the invention operates in such manner that two-arm lever 14 is controlled by cam 12. Arm 15 of lever 14 bears against the stop 17 of sleeve 18 via roller 16. This motion is transmitted via pivot shaft 5 as far as gripping disc 6, which, before each gripping of weft thread 8, projects with its axially projecting toothing 7 from the hollow of measuring drum 3 and grips the weft thread 8 by one of its teeth 7, said weft thread being fed by the guide 24 from the nip roller 4. It will be understood that the weft thread 8 had been wound onto the cylindrical surface of measuring drum 3, when the end of the cut weft thread 8 was gripped by pliers 27 which are controlled by a cam (not shown). Shortly before the moment of insertion, the gripping disc 6 is drawn back into the hollow of measuring drum 3 by the action of cam 12 via the described control members, and the weft thread 8 is withdrawn from the teeth 7 of the gripping disc 6 by the aid of the annular insert 9 and is then withdrawn from the cylindrical surface of the measuring drum 3 by the action of the inserting means 28 and inserted into the shed.

Although the invention is illustrated and described with reference to a single preferred embodiment thereof, it is to be expressly understood that it is in no way limited to the disclosure of such a preferred embodiment, but is capable of numerous modifications within the scope of the appended claims.

What is claimed is:

1. In a device for gripping and forming a supply of measured weft threads before weft insertion having a rotary measuring drum with a nip disc, the measuring drum having a forwardly open space therewithin and being mounted on a driving shaft, the improvement which comprises an axially displaceable gripping disc mounted on the driving shaft, the gripping disc being provided with a circumferential rim provided with axially projecting teeth spaced thereabout at its forward end, an annular housing coaxial of and surrounding the forward end of the measuring drum and the gripping disc therewithin, the housing and measuring drum presenting an annular groove therebetween through which the measured weft passes to the weft inserting means, the position and axial depth of the annular groove corresponding substantially to the axial length of the teeth on the rim of the gripping disc, and means for cyclically displacing the gripping disc from an axially advanced forward position in which a weft thread is gripped by the teeth on the gripping disc to an axially retracted position in which the weft thread is released from the teeth on the gripping disc.

2. A device according to claim 1, wherein the groove between the housing and measuring drum is at least partly frusto-conical in axial section.

3. A device according to claim 1, wherein the gripping disc is of cylindrical channel shape having radially inner and outer walls, said radially outer wall bearing said teeth, and comprising an annular member freely mounted within the cylindrical channel coaxial thereof, the annular member being mounted upon the measuring drum.

4. A device according to claim 3, comprising spacer studs extending parallel to said shaft connecting the annular member to the measuring drum.

* * * * *